US009487849B2

(12) United States Patent
Ishii et al.

(10) Patent No.: US 9,487,849 B2
(45) Date of Patent: Nov. 8, 2016

(54) FERRITIC STAINLESS STEEL

(71) Applicant: JFE STEEL CORPORATION, Chiyoda-ku, Tokyo (JP)

(72) Inventors: Tomohiro Ishii, Chiba (JP); Shin Ishikawa, Chiba (JP); Hiroyuki Ogata, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 14/360,192

(22) PCT Filed: Nov. 28, 2012

(86) PCT No.: PCT/JP2012/007614

§ 371 (c)(1),
(2) Date: May 22, 2014

(87) PCT Pub. No.: WO2013/080526

PCT Pub. Date: Jun. 6, 2013

(65) Prior Publication Data

US 2014/0308154 A1 Oct. 16, 2014

(30) Foreign Application Priority Data

Nov. 30, 2011 (JP) ..... 2011-261094

(51) Int. Cl.
*C22C 38/42* (2006.01)
*C22C 38/44* (2006.01)
(Continued)

(52) U.S. Cl.
CPC ..... *C22C 38/52* (2013.01); *C21D 9/46* (2013.01); *C22C 38/00* (2013.01); *C22C 38/001* (2013.01);
(Continued)

(58) Field of Classification Search
CPC . C21D 2211/005; C22C 38/44; C22C 38/46; C22C 38/48; C22C 38/50; C22C 38/52; C22C 38/54
See application file for complete search history.

(56) References Cited

U.S. PATENT DOCUMENTS 4,059,440 A 11/1977 Takemura et al.
5,413,754 A * 5/1995 Yazawa ..... C22C 38/18 420/41

(Continued)

FOREIGN PATENT DOCUMENTS

EP 2280090 2/2011
JP S 51-88413 A 8/1976

(Continued)

OTHER PUBLICATIONS

International Search Report dated Jan. 15, 2013, application No. PCT/JP2012/007614.

(Continued)

*Primary Examiner* — Scott Kastler
*Assistant Examiner* — Vanessa Luk
(74) *Attorney, Agent, or Firm* — RatnerPrestia

(57) ABSTRACT

The invention provides ferritic stainless steels exhibiting good weldability and excellent corrosion resistance even under such welding conditions that sensitization is induced. The ferritic stainless steel includes, by mass %, C: 0.001 to 0.030%, Si: more than 0.3 to 0.55%, Mn: 0.05 to 0.50%, P: not more than 0.05%, S: not more than 0.01%, Cr: 19.0 to 28.0%, Ni: 0.01 to less than 0.30%, Mo: 0.2 to 3.0%, Al: more than 0.08 to 1.2%, V: 0.02 to 0.50%, Cu: less than 0.1%, Nb: 0.005 to 0.50%, Ti: 0.05 to 0.50%, and N: 0.001 to 0.030%, the balance being Fe and inevitable impurities, the ferritic stainless steel satisfying Equations (1) and (2).

8 Claims, 2 Drawing Sheets

(51) Int. Cl.

| | |
|---|---|
| ***C22C 38/46*** | (2006.01) |
| ***C22C 38/48*** | (2006.01) |
| ***C22C 38/50*** | (2006.01) |
| ***C22C 38/52*** | (2006.01) |
| ***C21D 9/46*** | (2006.01) |
| ***C22C 38/00*** | (2006.01) |
| ***C22C 38/54*** | (2006.01) |
| ***C22C 38/02*** | (2006.01) |
| ***C22C 38/04*** | (2006.01) |
| ***C22C 38/06*** | (2006.01) |

(52) U.S. Cl.

CPC ..... *C22C 38/004* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/005* (2013.01)

(56) References Cited

U.S. PATENT DOCUMENTS 6,786,981 B2 * 9/2004 Yazawa et al. ..... 148/325
7,494,551 B2 * 2/2009 Yazawa ..... C22C 38/50 148/325
7,806,993 B2 * 10/2010 Miyazaki ..... C21D 6/002 148/325
2010/0061878 A1 * 3/2010 Fukuda ..... C21D 6/002 420/61
2010/0122800 A1 5/2010 Nishida

FOREIGN PATENT DOCUMENTS

| | | | |
|---|---|---|---|
| JP | 11323502 | | 11/1999 |
| JP | 2007-270290 | A | 10/2007 |
| JP | 2008-190035 | A | 8/2008 |
| JP | 2009-161836 | A | 7/2009 |
| JP | 2009-174046 | A | 8/2009 |
| JP | 2010-202916 | A | 9/2010 |
| JP | 2011-190524 | A | 9/2011 |
| KR | 100733016 | | 6/2007 |
| KR | 100501625 | | 7/2015 |

OTHER PUBLICATIONS

Korean Office Action dated Jan. 21, 2016 for Korean Application No. 2014-7015802 with partial translation.
European Search Report mailed Sep. 23, 2015 in European Application No. 12853515.0.

* cited by examiner

FERRITIC STAINLESS STEEL

CROSS REFERENCE TO RELATED APPLICATIONS

This is the U.S. National Phase application of PCT/JP2012/007614, filed Nov. 28, 2012, which claims priority to Japanese Patent Application No. 2011-261094, filed Nov. 30, 2011, the disclosures of each of these applications being incorporated herein by reference in their entireties for all purposes.

FIELD OF THE INVENTION

The present invention relates to ferritic stainless steels having a low probability of a decrease in corrosion resistance due to the entering of nitrogen from a weld shielding gas into a weld bead.

BACKGROUND OF THE INVENTION

As compared to austenitic stainless steel, ferritic stainless steel has a higher cost performance in terms of corrosion resistance as well as a better heat thermal conductivity and a smaller coefficient of thermal expansion and is more resistant to stress corrosion cracking. Due to these excellent characteristics, ferritic stainless steel has been used in a wide range of applications including automobile exhaust system components, building materials such as roofs and fittings, and materials used in wet condition such as kitchen furniture, water tanks and hot water tanks.

These structures are most often manufactured by welding stainless steel sheets that have been cut and formed into appropriate shapes. Because ferritic stainless steel has low solid solubility limits of carbon and nitrogen, welding of ferritic stainless steel tends to result in the occurrence of a phenomenon called sensitization in which Cr carbonitride is produced at the weld in the process of the melting and solidification during welding and consequently a Cr depletion layer is formed to cause a decrease in corrosion resistance.

A conventional remedy to this is to add titanium or niobium having higher affinity for carbon and nitrogen than does chromium, thereby suppressing the formation of Cr carbonitride and the occurrence of sensitization. For example, Patent Literature 1 discloses ferritic stainless steel improved in grain boundary corrosion resistance by the combined addition of titanium and niobium.

As the shapes of components that are welded have become more complicated in recent years, sufficient gas shielding during welding is often failed and welding is frequently carried out under such unsatisfactory conditions that atmospheric nitrogen gets mixed with the shielding gas. Under such welding conditions, nitrogen in the shielding gas enters a weld bead to further increase the probability of sensitization at the weld. Thus, difficulties are encountered in ensuring corrosion resistance with conventional ferritic stainless steels disclosed in literature such as Patent Literature 1.

Ferritic stainless steels with excellent weld corrosion resistance have been disclosed. For example, Patent Literature 2 discloses ferritic stainless steel with excellent corrosion resistance at welds, Patent Literature 3 discloses ferritic stainless steel with excellent corrosion resistance at weld gaps, and Patent Literature 4 discloses ferritic stainless steel with excellent corrosion resistance at welds with austenitic stainless steel. Even with these ferritic stainless steels, however, sufficient corrosion resistance cannot be always ensured under such welding conditions that nitrogen will enter from a shielding gas into a weld bead.

PATENT LITERATURE

[PTL 1] Japanese Unexamined Patent Application Publication No. 51-88413

[PTL 2] Japanese Unexamined Patent Application Publication No. 2007-270290

[PTL 3] Japanese Unexamined Patent Application Publication No. 2009-161836

[PTL 4] Japanese Unexamined Patent Application Publication No. 2010-202916

SUMMARY OF THE INVENTION

In order to solve the aforementioned problems in the conventional art, a possible approach is to increase the amounts of titanium and niobium in line with the conventional idea so as to suppress the occurrence of sensitization. However, this approach is not an appropriate solution because other problems such as an increase in surface defects and the occurrence of weld cracks are caused.

The invention therefore aims to provide ferritic stainless steels exhibiting good weldability and excellent corrosion resistance even when welded under such welding conditions that sufficient gas shielding is infeasible for reasons such as the shapes of workpieces and consequently nitrogen is mixed to the shielding gas to raise the nitrogen content in the weld bead and to induce the occurrence of sensitization.

In the present invention, extensive studies have been carried out in order to solve the aforementioned problems focusing on the behavior of nitrogen entering a weld bead as well as the influences of elements on the suppression of sensitization.

First, studies were made on how the nitrogen content in a weld bead would be affected by the nitrogen concentration in a shielding gas. Ferritic stainless steel No. 1 described in Table 1 was subjected to bead-on-plate TIG welding (welding current 90 Ampere, welding speed 60 cm/min, sheet thickness 0.8 mm, face shielding gas flow rate 15 Liter/min, back shielding gas flow rate 10 Liter/min) while the nitrogen concentration in an Ar-based shielding gas was varied in the range of 0 to 2 vol %, and the nitrogen content in the weld bead was measured. The results are described in FIG. 1.

When nitrogen was added to the face shielding gas, the nitrogen content in the weld bead was increased in proportion to the increase in the nitrogen concentration in the shielding gas. On the other hand, when nitrogen was added to the back shielding gas, the nitrogen content in the weld bead remained substantially unchanged even when the nitrogen concentration in the shielding gas was increased. This result is probably ascribed to the condition that the face shielding gas is continuously blown from a nozzle to the molten pool while the back shielding gas is brought into a mild contact therewith. Sensitization occurred at the weld beads more markedly with increasing amount of nitrogen that had entered the weld beads. From this result, it is probable that the sensitization at weld beads occurs due to the entering into the weld beads of nitrogen mixed in the face shielding gas.

Next, the influences of elements on sensitization were evaluated under welding conditions in which nitrogen was added to the shielding gas to induce the occurrence of sensitization at weld beads. Various ferritic stainless steels were subjected to bead-on-plate TIG welding with use of Ar gas having a nitrogen concentration of 2 vol % as the face shielding gas. After the weld beads were completely descaled by polishing, the reactivation rate was measured in accordance with JIS G 0580 (2003). The reactivation rate in the present specification indicates a value without correction based on crystal grain size. The results are described in FIG. 2.

The logarithm of the reactivation rate was decreased in proportion to Nb+1.3Ti+0.9V+0.2Al (the chemical symbols in the expression represent the contents (mass %) of the respective elements) (hereinafter, referred to as the value N). A smaller value of reactivation rate indicates a lower degree of sensitization, and it is understood that substantially no sensitization has occurred when the reactivation rate is 0.01% or less. The reactivation rate was 0.01% or less when the value N was larger than 0.55. Thus, it has been demonstrated that good corrosion resistance is obtained even under such welding conditions that usual ferritic stainless steels will suffer sensitization at weld beads due to the entering of nitrogen from the shielding gas.

Further, Cr depletion occurs at weld beads in the similar way as in the sensitization due to the formation of an oxide layer called a temper color, resulting in a decrease in corrosion resistance. The influences of elements on the corrosion resistance of a temper color under sensitization-inducing welding conditions were evaluated by pitting potential measurement. Various ferritic stainless steels were subjected to bead-on-plate TIG welding with use of Ar gas having a nitrogen concentration of 2 vol % as the face shielding gas, and the pitting potential was measured in a 3.5 mass % NaCl solution at 30° C. without removing the temper color that had been formed by the welding on the face side (the torch side) of the weld bead. The results are described in FIG. 3.

When the value N was 0.34, the pitting potential was in the range of −200 to −150 mVolts irrespective of the content of silicon plus aluminum plus titanium, indicating low corrosion resistance. When the value N was 0.57, on the other hand, the pitting potential was 0 mVolt or above, namely, the corrosion resistance was improved when Si+Al+Ti (the chemical symbols in the expression represent the contents (mass %) of the respective elements) (hereinafter, referred to as the value S) was in the range of 0.6 to 1.8. This result is probably because the enrichment of the temper color with silicon, aluminum and titanium results in a dense and highly protective oxide layer, and also reduces the amount of oxidation by welding to suppress the depletion of chromium in the superficial layer of the weld bead by oxidation. The Cr depletion by the formation of a temper color produces synergetic effects in combination with the Cr depletion in the vicinity of Cr carbonitride which occurs by sensitization due to the entering of nitrogen. Thus, it is considered to be necessary that the value N and the value S be in respective appropriate ranges in order to ensure corrosion resistance of weld beads under such welding conditions that nitrogen will enter from the shielding gas into the weld beads.

The present invention has been made based on the aforementioned findings and on further studies. The summary of the invention includes the following.

[1] A ferritic stainless steel with excellent corrosion resistance at welds, including, by mass %, C: 0.001 to 0.030%, Si: more than 0.3 to 0.55%, Mn: 0.05 to 0.50%, P: not more than 0.05%, S: not more than 0.01%, Cr: 19.0 to 28.0%, Ni: 0.01 to less than 0.30%, Mo: 0.2 to 3.0%, Al: more than 0.08 to 1.2%, V: 0.02 to 0.50%, Cu: less than 0.1%, Nb: 0.005 to 0.50%, Ti: 0.05 to 0.50%, and N: 0.001 to 0.030%, the balance being Fe and inevitable impurities, the ferritic stainless steel satisfying the following equations (1) and (2):

$$0.6 \leq Si+Al+Ti \leq 1.8 \quad (1)$$

$$Nb+1.3Ti+0.9V+0.2Al > 0.55 \quad (2)$$

wherein the chemical symbols in the expressions represent the contents (mass %) of the respective elements.

[2] The ferritic stainless steel with excellent corrosion resistance at welds described in [1], further including, by mass %, one or more selected from Zr: not more than 1.0%, W: not more than 1.0%, REM: not more than 0.1%, Co: not more than 0.3% and B: not more than 0.1%.

According to the present invention, ferritic stainless steels are obtained which exhibit excellent corrosion resistance even under such welding conditions that sensitization is induced by the entering of nitrogen from a shielding gas into a weld bead. Further, the ferritic stainless steels of the invention have good weldability comparable to that of conventional steels.

DETAILED DESCRIPTION OF EMBODIMENTS OF THE INVENTION

Figure 1:
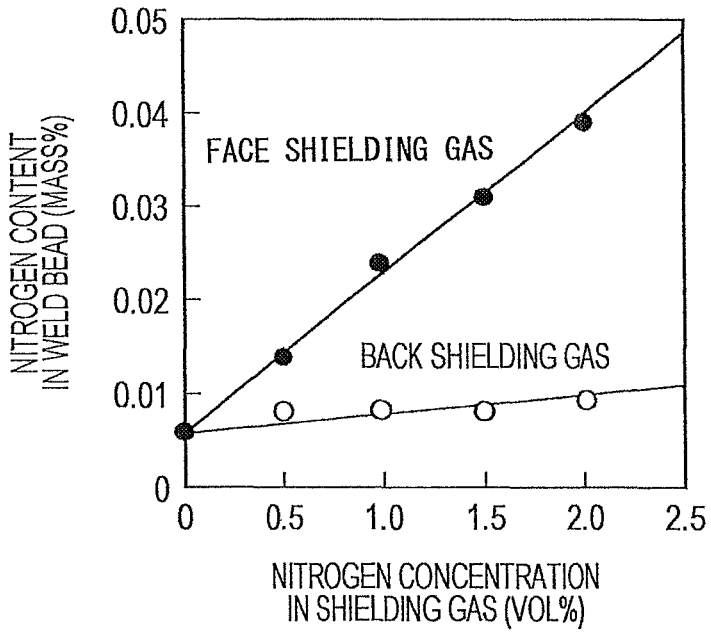
FIG. 1 is a view illustrating how the nitrogen content in a weld bead is affected by the nitrogen concentration in a shielding gas.

Hereinbelow, there will be described the reasons why the components in the invention are preferred as such.

1. Chemical Composition

First, the reasons why the preferred chemical composition of the inventive steel is specified will be described. In the chemical composition, % indicates mass % at each occurrence.

C: 0.001 to 0.030%

Carbon is an element that is inevitably found in steel. Increasing the C content enhances strength, and decreasing the C content enhances workability. In order to obtain sufficient strength, it is appropriate to add carbon to a content of not less than 0.001%. Adding carbon in excess of 0.030% results in a marked decrease in workability as well as increases the risk that corrosion resistance will be lowered by the precipitation of Cr carbide which causes local Cr depletion. Thus, the C content is specified to be in the range of 0.001 to 0.030%. The C content is preferably in the range of 0.002 to 0.018%, more preferably in the range of 0.003 to 0.015%, and still more preferably in the range of 0.003 to 0.010%.

Si: more than 0.3 to 0.55%

Silicon is an element effective for deoxidation. In the present invention, this element plays an important role by being concentrated, together with aluminum and titanium, in a temper color formed by welding so as to improve the protective performance of the oxide layer and to improve the corrosion resistance of the weld. Under such welding conditions that nitrogen will enter from a shielding gas, the concentrating of aluminum and titanium at the temper color is small because these elements form precipitates by bonding to the nitrogen that has entered. Thus, in the invention, silicon plays a relatively larger role in the enhancement of the protective performance of the temper color. This effect may be obtained by adding silicon in excess of 0.3%. However, the addition in excess of 0.55% results in a marked decrease in workability and makes forming and working difficult. Thus, the Si content is specified to be in the range of more than 0.3 to 0.55%. The Si content is preferably in the range of 0.33 to 0.50%, and more preferably in the range of 0.35 to 0.48%.

Mn: 0.05 to 0.50%

Manganese is an element that is inevitably contained in steel and has an effect on increasing strength. This effect may be obtained by adding manganese to 0.05% or more. However, any excessive addition facilitates the precipitation of MnS which serves as a corrosion starting point, and thus deteriorates corrosion resistance. It is therefore appropriate that the Mn content be not more than 0.50%. Thus, the Mn content is specified to be in the range of 0.05 to 0.50%. The Mn content is preferably in the range of 0.08 to 0.40%, and more preferably in the range of 0.09 to 0.35%.

P: not more than 0.05%

Phosphorus is an element that is inevitably contained in steel. An excessively high content thereof causes a decrease in weldability and facilitates the occurrence of grain boundary corrosion. This tendency becomes marked when the P content exceeds 0.05%. Thus, the P content is specified to be not more than 0.05%. The P content is preferably not more than 0.04%.

S: not more than 0.01%

Sulfur is an element that is inevitably contained in steel. Any S content exceeding 0.01% causes a decrease in corrosion resistance. Thus, the S content is specified to be not more than 0.01%. The S content is more preferably not more than 0.006%.

Cr: 19.0 to 28.0%

Chromium is the most important element for ensuring the corrosion resistance of stainless steel. If the Cr content is less than 19.0%, sufficient corrosion resistance cannot be obtained at and in the vicinity of weld beads where the Cr content in the superficial layer is decreased by oxidation during welding. On the other hand, adding chromium in excess of 28.0% results in decreases in workability and productivity. Thus, the Cr content is specified to be in the range of 19.0 to 28.0%. The Cr content is preferably in the range of 21.0 to 26.0%, and more preferably in the range of 21.0 to 24.0%.

Ni: 0.01 to less than 0.30%

Nickel is an element that enhances the corrosion resistance of stainless steel. This element suppresses the progress of corrosion in a corrosive environment in which any passivation film is not formed and consequently active dissolution takes place. This effect may be obtained by adding nickel to 0.01% or more. However, the addition of nickel to 0.30% or more results in a decrease in workability as well as an increase in cost due to the expensiveness of the element. Thus, the Ni content is specified to be in the range of 0.01 to less than 0.30%. The Ni content is preferably in the range of 0.03 to 0.24%.

Mo: 0.2 to 3.0%

Molybdenum is an element that enhances the corrosion resistance of stainless steel by promoting the repassivation of a passivation film. This effect is exhibited more markedly when stainless steel contains molybdenum together with chromium. The corrosion resistance enhancement effect by molybdenum may be obtained by adding molybdenum to 0.2% or more. If the Mo content exceeds 3.0%, however, strength is so increased that a high rolling load is incurred to lower productivity. Thus, the Mo content is specified to be in the range of 0.2 to 3.0%. The Mo content is preferably in the range of 0.6 to 2.4%, and more preferably in the range of 0.6 to 2.0%.

Al: more than 0.08 to 1.2%

Aluminum is an element effective for deoxidation. In the invention, aluminum is concentrated at a temper color formed by welding together with silicon and titanium to enhance the corrosion resistance of the weld. In addition, this element is effective for suppressing the occurrence of sensitization which caused by the precipitation of chromium with nitrogen in the case that nitrogen has entered from a shielding gas into the weld bead. This effect is probably exhibited by a process in which aluminum having higher affinity for nitrogen than does chromium forms AlN with the nitrogen that has entered the weld bead from the shielding gas, thus suppressing the formation of Cr nitride. This effect may be obtained by adding aluminum in excess of 0.08%. However, the addition in excess of 1.2% results in an increase in ferrite crystal grains and consequent decreases in workability and productivity. Thus, the Al content is specified to be in the range of more than 0.08 to 1.2%. The Al content is preferably in the range of 0.09 to 0.8%, and more preferably in the range of 0.10 to 0.40%.

V: 0.02 to 0.50%

Vanadium is an element that enhances corrosion resistance and workability. In the invention, when nitrogen has entered from a shielding gas into a weld bead, vanadium suppresses the occurrence of sensitization by combining with nitrogen to form VN. This effect may be obtained by adding vanadium to 0.02% or more. However, the addition in excess of 0.50% results in a decrease in workability. Thus, the V content is specified to be in the range of 0.02 to 0.50%. The V content is preferably in the range of 0.03 to 0.40%.

Cu: less than 0.1%

Copper is an impurity possibly mixed in stainless steel, originating from raw material scraps. When this element is present in the ferritic stainless steel with excellent corrosion resistance having the preferred Cr and Mo contents, the passivity-maintaining current is increased and the passivation film is destabilized. Consequently, a decrease in corrosion resistance is caused. This effect of decreasing the corrosion resistance becomes marked when the Cu content is 0.1% or more. Thus, the Cu content is specified to be less than 0.1%.

Nb: 0.005 to 0.50%

Niobium bonds preferentially to carbon and nitrogen to suppress the decrease in corrosion resistance by the precipitation of Cr carbonitride. Thus, in the invention, niobium is an important element for suppressing the occurrence of sensitization by the entering of nitrogen from a shielding gas. This effect may be obtained when the Nb content is 0.005% or more. If the Nb content exceeds 0.50%, however, hot strength is so increased that a high hot rolling load is incurred to lower productivity. Further, niobium, when present in such an excessively high content, is precipitated at crystal grain boundaries in welds to increase the risk of weld cracks. Thus, the Nb content is specified to be in the range of 0.005 to 0.50%. The Nb content is preferably in the range of 0.01 to 0.38%, and more preferably in the range of 0.05 to 0.35%.

Ti: 0.05 to 0.50%

Titanium bonds preferentially to carbon and nitrogen to suppress the decrease in corrosion resistance by the precipitation of Cr carbonitride. In the invention, titanium is an important element for suppressing the occurrence of sensitization by the entering of nitrogen from a shielding gas.

Further, titanium is concentrated in a complex manner with silicon and aluminum in a temper color at a weld so as to improve the protective performance of the oxide layer. These effects may be obtained when the Ti content is 0.05% or more. If the Ti content exceeds 0.50%, however, workability is deteriorated and Ti carbonitride becomes coarsened to cause surface defects. Thus, the Ti content is specified to be in the range of 0.05 to 0.50%. The Ti content is preferably in the range of 0.08 to 0.38%.

N: 0.001 to 0.030%

Nitrogen is an element that is inevitably contained in steel similarly to carbon. This element has an effect of increasing the strength of steel by solid solution hardening. This effect may be obtained when the N content is 0.001% or more. The N content is appropriately not more than 0.030% because the precipitation of Cr nitride deteriorates corrosion resistance. Thus, the N content is specified to be in the range of 0.001 to 0.030%. The N content is preferably in the range of 0.002 to 0.018%.

Si+Al+Ti (value S): 0.6 to 1.8

The chemical symbols in the expression represent the contents (mass %) of the respective elements.

Figure 3:
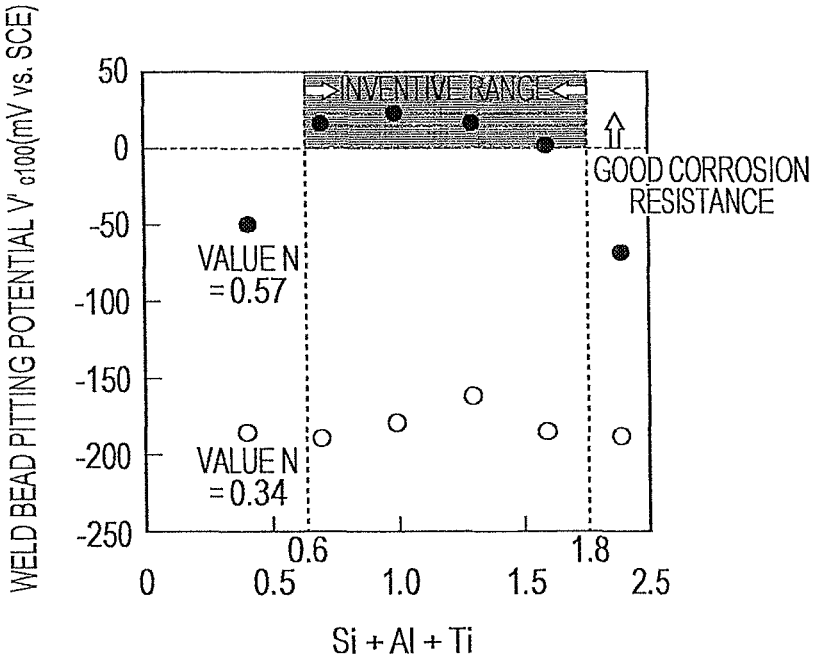
FIG. 3 is a view illustrating the influences of elements on the pitting potential of a weld bead.

Silicon, aluminum and titanium all have high affinity for oxygen. When stainless steel is oxidized and oxide scales are formed, these elements become concentrated in a lower layer (on the base iron side) of the oxide scales. In the case where stainless steel contains all of these elements, the Si-, Al- and Ti-enriched layer formed by the complex oxidation of silicon, aluminum and titanium is a dense and highly protective oxide layer which achieves higher corrosion resistance compared to when the contents of these elements are low. This effect may be obtained when the value S is 0.6 or more. Under such welding conditions that nitrogen will enter from a shielding gas into a weld bead, as illustrated in FIG. 3, the effect of enhancing the corrosion resistance of a temper color at the weld is clearly exhibited only when the value N described later is 0.55 or more. This fact suggests that the protective effect by silicon, aluminum and titanium works in a complex manner with the effect of the value N so as to enhance the corrosion resistance of the welds. If the value S exceeds 1.8, on the other hand, the crystallinity of the oxide layer is so increased that the effect of suppressing the penetration of metal ions or the like is lowered. Consequently, as illustrated in FIG. 3, the corrosion resistance is decreased again when the value S is in excess of 1.8. From these results, the value S is specified to be from 0.6 to 1.8. The value S is preferably from 0.6 to 1.4.

Nb+1.3Ti+0.9V+0.2Al (value N): more than 0.55

The chemical symbols in the expression represent the contents (mass %) of the respective elements.

Figure 2:
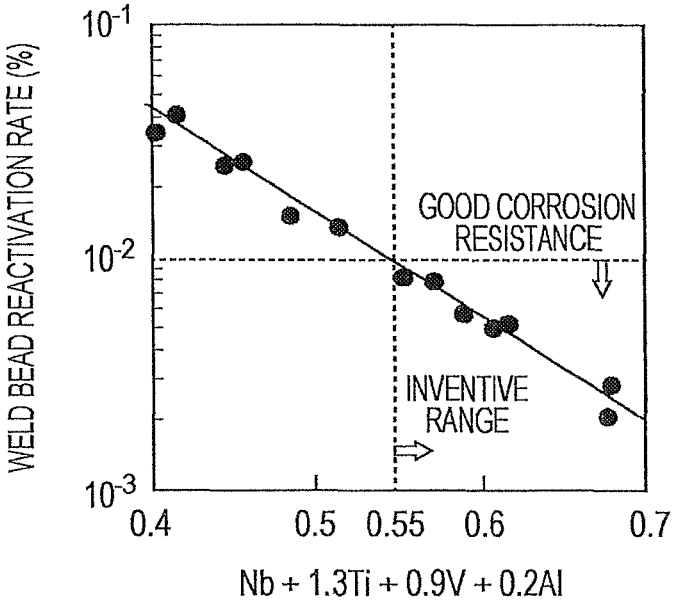
FIG. 2 is a view illustrating the influences of elements on the reactivation rate of a weld bead.

The sensitization of weld beads treated in the present invention is mainly ascribed to the occurrence of a local Cr depletion region as a result of the formation of Cr nitride by the bonding of chromium with nitrogen that has entered from a shielding gas into the weld beads. To suppress this, the addition of elements having higher affinity for nitrogen than chromium has is considered effective. While titanium and niobium are well known to stabilize carbon and nitrogen, it has been newly found in the invention that aluminum and vanadium have an effect of stabilizing carbon and nitrogen in a weld bead under such welding conditions that nitrogen will enter from a shielding gas into the weld bead. Since the logarithm of the weld bead reactivation rate is in proportion to the value N as illustrated in FIG. 2, the contributions of the elements to the effect relative to their mass % are greater in the order of Ti>Nb>V>Al. When the value N is more than 0.55, the weld bead reactivation rate is 0.01% or less, indicating that substantially no sensitization has occurred. Thus, the value N is specified to be more than 0.55.

Precipitates in a weld bead were observed with a SEM (scanning electron microscope). The observation confirmed that aluminum and vanadium were present forming complexes with Ti and Nb carbonitrides. It is considered that vanadium and aluminum are allowed to exhibit the nitrogen-stabilizing effect more markedly as a result of the facilitated precipitation of AlN and VN on the Ti and Nb carbonitrides as nuclei.

The basic chemical composition in the invention is as described above, and the balance is Fe and inevitable impurities. Further, the Cu content may be limited from the viewpoint of corrosion resistance. In order to improve corrosion resistance and toughness, zirconium, tungsten, rare earth metals, cobalt and boron may be added as optional elements.

Zr: not more than 1.0%

Zirconium has an effect of suppressing the occurrence of sensitization by bonding to carbon and nitrogen. This effect may be obtained by the addition of zirconium to 0.01% or more. However, any excessive addition results in a decrease in workability and an increase in cost because of the expensiveness of the element. Thus, when zirconium is added, the Zr content is preferably not more than 1.0%, and more preferably not more than 0.2%.

W: not more than 1.0%

Tungsten has an effect of enhancing corrosion resistance similarly to molybdenum. This effect may be obtained by the addition of tungsten to 0.01% or more. However, any excessive addition results in an increase in strength and a decrease in productivity. Thus, when tungsten is added, the W content is preferably not more than 1.0%, and more preferably not more than 0.2%.

REM: not more than 0.1%

Rare earth metals (REM) enhance oxidation resistance to suppress the formation of oxide scales and to suppress the formation of a Cr depletion region immediately below a temper color at a weld. This effect may be obtained by adding REM to 0.0001% or more. However, any excessive addition results in a decrease in productivity such as acid pickling properties as well as an increase in cost. Thus, when rare earth metals are added, the REM content is preferably not more than 0.1%, and more preferably not more than 0.05%.

Co: not more than 0.3%

Cobalt is an element that enhances toughness. This effect may be obtained by adding cobalt to 0.001% or more. However, any excessive addition results in a decrease in productivity. Thus, when cobalt is added, the Co content is preferably not more than 0.3%, and more preferably not more than 0.1%.

B: not more than 0.1%

Boron is an element that improves secondary working brittleness resistance. To obtain this effect, the B content is appropriately 0.0001% or more. However, an excessively high B content causes a decrease in ductility by solid solution hardening. Thus, when boron is added, the B content is preferably not more than 0.1%, and more preferably not more than 0.05%.

2. Manufacturing Conditions

Next, a preferred method for manufacturing the inventive steel will be described. A steel having the aforementioned chemical composition is smelted by a known method such as a converter furnace, an electric furnace or a vacuum melting furnace, and is processed into a steel material (slab) by continuous casting or ingot casting and slabbing process. The slab is then heated to 1100 to 1300° C. and hot rolled to a sheet thickness of 2.0 mm to 5.0 mm at a finishing temperature of 700° C. to 1000° C. and a coiling temperature of 500° C. to 850° C. The resultant hot rolled strip is annealed at a temperature of 800° C. to 1200° C., then subjected to acid pickling, and cold rolled. The cold rolled sheet is annealed at a temperature of 700° C. to 1100° C. After the annealing of the cold rolled sheet, acid pickling is performed to remove scales. The descaled cold rolled strip may be skin-pass rolled.

Example 1

Hereinbelow, the present invention will be described based on EXAMPLES.

Stainless steels described in Table 1 were vacuum smelted. After being heated to 1200° C., the steels were hot rolled to a sheet thickness of 4 mm, annealed in the range of 850 to 1050° C., and subjected to acid pickling to remove scales. Further, the steel sheets were cold rolled to a sheet thickness of 0.8 mm, annealed in the range of 800° C. to 1000° C., and subjected to acid pickling to give specimens. The value S and the value N in Table 1 are defined by Si+Al+Ti and Nb+1.3Ti+0.9V+0.2Al (the chemical symbols in the expressions represent mass %), respectively.

The specimens were subjected to bead-on-plate TIG welding. The welding current was 90 Ampere, and the welding speed was 60 cm/min. The shielding gas used on the face side (the torch side) was Ar gas containing 2 vol % nitrogen which was supplied at a flow rate of 15 Liter/min, and that on the back side was 100% Ar gas which was supplied at a flow rate of 10 Liter/min. The width of the weld bead on the face side was about 4 mm.

A 20 mm square test piece including the weld bead was sampled and was covered with a sealing material while leaving a 10 mm square zone exposed for measurement. The pitting potential was measured in a 3.5% NaCl solution at 30° C. without removing the temper color that had been formed by the welding. The test piece had not been polished or passivated. Other measurement conditions were in accordance with JIS G 0577 (2005). The measured pitting potentials $V'_{C100}$ are described in Table 2.

TABLE 2

Results of evaluations of specimen performances

| No. | Pitting potential Vc' 100 at welding bead mV vs SCE | Corrosion in neutral salt spray cyclic corrosion test | Remarks |
|---|---|---|---|
| 1 | 22 | Absent | Inv. Ex. |
| 2 | 16 | Absent | Inv. Ex. |
| 3 | 26 | Absent | Inv. Ex. |
| 4 | 17 | Absent | Inv. Ex. |
| 5 | 13 | Absent | Inv. Ex. |
| 6 | 24 | Absent | Inv. Ex. |
| 7 | 25 | Absent | Inv. Ex. |

TABLE 1

Chemical compositions of specimens (mass %)

| No. | C | Si | Mn | P | S | Cr | Ni | Mo | Al | V | Nb | Ti | N | Cu | Other elements | Value S | Value N | Remarks |
|---|---|---|---|---|---|---|---|---|---|---|---|---|---|---|---|---|---|---|
| 1 | 0.003 | 0.42 | 0.12 | 0.03 | 0.001 | 21.7 | 0.09 | 1.10 | 0.11 | 0.13 | 0.21 | 0.18 | 0.006 | — | | 0.71 | 0.583 | Inv. Ex. |
| 2 | 0.004 | 0.34 | 0.11 | 0.02 | 0.001 | 21.2 | 0.08 | 1.09 | 0.14 | 0.14 | 0.25 | 0.13 | 0.008 | — | | 0.61 | 0.573 | Inv. Ex. |
| 3 | 0.005 | 0.51 | 0.11 | 0.02 | 0.001 | 22.3 | 0.08 | 1.10 | 0.11 | 0.14 | 0.17 | 0.25 | 0.008 | — | | 0.87 | 0.643 | Inv. Ex. |
| 4 | 0.003 | 0.38 | 0.14 | 0.02 | 0.002 | 19.4 | 0.08 | 1.37 | 0.10 | 0.10 | 0.22 | 0.18 | 0.007 | 0.04 | | 0.66 | 0.564 | Inv. Ex. |
| 5 | 0.005 | 0.40 | 0.15 | 0.02 | 0.002 | 20.8 | 0.13 | 1.08 | 0.09 | 0.24 | 0.31 | 0.12 | 0.010 | 0.02 | | 0.61 | 0.700 | Inv. Ex. |
| 6 | 0.005 | 0.40 | 0.14 | 0.02 | 0.001 | 22.7 | 0.12 | 1.07 | 0.78 | 0.11 | 0.20 | 0.20 | 0.009 | — | | 1.38 | 0.715 | Inv. Ex. |
| 7 | 0.004 | 0.39 | 0.14 | 0.03 | 0.001 | 22.8 | 0.11 | 1.08 | 1.10 | 0.11 | 0.23 | 0.15 | 0.009 | — | | 1.64 | 0.744 | Inv. Ex. |
| 8 | 0.005 | 0.35 | 0.11 | 0.02 | 0.001 | 22.4 | 0.11 | 2.01 | 0.10 | 0.08 | 0.22 | 0.24 | 0.008 | — | | 0.69 | 0.624 | Inv. Ex. |
| 9 | 0.006 | 0.34 | 0.12 | 0.02 | 0.001 | 24.5 | 0.13 | 1.92 | 0.10 | 0.46 | 0.18 | 0.17 | 0.012 | — | | 0.61 | 0.835 | Inv. Ex. |
| 10 | 0.005 | 0.47 | 0.12 | 0.02 | 0.001 | 24.8 | 0.11 | 1.05 | 0.16 | 0.21 | 0.11 | 0.35 | 0.010 | — | | 0.98 | 0.786 | Inv. Ex. |
| 11 | 0.005 | 0.47 | 0.11 | 0.02 | 0.001 | 24.5 | 0.09 | 1.05 | 0.15 | 0.19 | 0.28 | 0.14 | 0.010 | 0.01 | | 0.76 | 0.663 | Inv. Ex. |
| 12 | 0.005 | 0.42 | 0.13 | 0.03 | 0.001 | 26.1 | 0.08 | 1.04 | 0.29 | 0.10 | 0.33 | 0.08 | 0.009 | — | | 0.79 | 0.582 | Inv. Ex. |
| 13 | 0.004 | 0.39 | 0.11 | 0.02 | 0.002 | 27.3 | 0.08 | 1.02 | 0.12 | 0.06 | 0.19 | 0.23 | 0.008 | 0.02 | Zr: 0.05 | 0.74 | 0.567 | Inv. Ex. |
| 14 | 0.004 | 0.39 | 0.15 | 0.02 | 0.001 | 21.4 | 0.07 | 1.53 | 0.12 | 0.07 | 0.08 | 0.40 | 0.007 | — | W: 0.6 | 0.91 | 0.687 | Inv. Ex. |
| 15 | 0.007 | 0.41 | 0.16 | 0.02 | 0.002 | 21.6 | 0.08 | 1.53 | 0.15 | 0.09 | 0.22 | 0.17 | 0.014 | — | Zr: 0.02, REM: 0.02 | 0.73 | 0.552 | Inv. Ex. |
| 16 | 0.008 | 0.40 | 0.18 | 0.03 | 0.002 | 21.6 | 0.10 | 1.52 | 0.33 | 0.10 | 0.24 | 0.17 | 0.014 | — | Co: 0.04 | 0.90 | 0.617 | Inv. Ex. |
| 17 | 0.004 | 0.41 | 0.15 | 0.03 | 0.001 | 22.7 | 0.10 | 1.27 | 0.32 | 0.08 | 0.18 | 0.33 | 0.009 | — | W: 0.08, B: 0.001 | 1.06 | 0.745 | Inv. Ex. |
| 18 | 0.005 | 0.41 | 0.13 | 0.02 | 0.001 | 22.9 | 0.12 | 1.27 | 0.56 | 0.27 | 0.25 | 0.15 | 0.009 | — | REM: 0.01, Co: 0.007, B: 0.004 | 1.12 | 0.800 | Inv. Ex. |
| 19 | 0.006 | 0.26 | 0.12 | 0.02 | 0.001 | 22.8 | 0.08 | 0.99 | 0.16 | 0.12 | 0.24 | 0.22 | 0.008 | — | | 0.64 | 0.666 | Comp. Ex. |
| 20 | 0.006 | 0.80 | 0.12 | 0.02 | 0.001 | 23.3 | 0.11 | 0.98 | 1.03 | 0.09 | 0.20 | 0.18 | 0.008 | — | | 2.01 | 0.721 | Comp. Ex. |
| 21 | 0.004 | 0.32 | 0.12 | 0.02 | 0.001 | 23.2 | 0.09 | 0.98 | 0.06 | 0.09 | 0.30 | 0.13 | 0.009 | — | | 0.51 | 0.562 | Comp. Ex. |
| 22 | 0.004 | 0.39 | 0.13 | 0.03 | 0.001 | 23.2 | 0.08 | 1.12 | 0.33 | 0.01 | 0.15 | 0.21 | 0.010 | — | | 0.93 | 0.498 | Comp. Ex. |
| 23 | 0.004 | 0.39 | 0.11 | 0.02 | 0.002 | 23.4 | 0.09 | 1.10 | 0.09 | 0.11 | 0.34 | 0.02 | 0.010 | — | | 0.50 | 0.483 | Comp. Ex. |
| 24 | 0.004 | 0.40 | 0.11 | 0.03 | 0.001 | 22.9 | 0.10 | 1.11 | 0.10 | 0.12 | 0.001 | 0.30 | 0.010 | — | | 0.80 | 0.519 | Comp. Ex. |
| 25 | 0.004 | 0.40 | 0.12 | 0.03 | 0.001 | 22.8 | 0.10 | 1.11 | 0.17 | 0.08 | 0.16 | 0.15 | 0.010 | — | | 0.72 | 0.461 | Comp. Ex. |

Note:

Underlines indicate "Outside Inventive

TABLE 2-continued

| Results of evaluations of specimen performances | | | |
|---|---|---|---|
| No. | Pitting potential Vc' 100 at welding bead mV vs SCE | Corrosion in neutral salt spray cyclic corrosion test | Remarks |
| 8 | 32 | Absent | Inv. Ex. |
| 9 | 40 | Absent | Inv. Ex. |
| 10 | 29 | Absent | Inv. Ex. |
| 11 | 31 | Absent | Inv. Ex. |
| 12 | 38 | Absent | Inv. Ex. |
| 13 | 49 | Absent | Inv. Ex. |
| 14 | 42 | Absent | Inv. Ex. |
| 15 | 38 | Absent | Inv. Ex. |
| 16 | 37 | Absent | Inv. Ex. |
| 17 | 30 | Absent | Inv. Ex. |
| 18 | 32 | Absent | Inv. Ex. |
| 19 | −74 | Present | Comp. Ex. |
| 20 | −52 | Present | Comp. Ex. |
| 21 | −126 | Present | Comp. Ex. |
| 22 | −180 | Present | Comp. Ex. |
| 23 | −212 | Present | Comp. Ex. |
| 24 | −209 | Present | Comp. Ex. |
| 25 | −177 | Present | Comp. Ex. |

The $V'_{C100}$ values in Inventive Examples were all above 0 mVolt, while the $V'_{C100}$ values in Comparative Examples were all below 0 mVolt. Thus, it has been shown that excellent corrosion resistance was obtained in Inventive Examples. Separately, a 60×80 mm test piece including the weld bead was sampled, and the face side as the testing surface was subjected to a neutral salt spray cyclic corrosion test specified in JIS H 8502 (1999). The number of cycles was 3 cycles. After the test, the weld bead was visually inspected for the presence or absence of corrosion. The results are described in Table 2.

Corrosion was absent in all of Inventive Examples, while corrosion was observed in all of Comparative Examples. Thus, it has been demonstrated that the weld beads in Inventive Examples exhibited excellent corrosion resistance.

Nos. 1 to 3 in Table 1 show that the Si content in the preferred range ensures good corrosion resistance at welds.

From Nos. 4 and 13, it has been shown that the Cr content in the preferred range provides good corrosion resistance at welds. From Nos. 6 and 8, good corrosion resistance at welds is achieved when the Mo content is in the preferred range. From Nos. 5 to 7, it has been shown that the Al content in the preferred range ensures good corrosion resistance at welds. Nos. 8 and 9 show that the V content in the preferred range provides good corrosion resistance at welds.

From Nos. 10 to 12, it has been shown that good corrosion resistance at welds is obtained when the Nb and Ti contents are in the preferred ranges. Nos. 4, 5, 11 and 13 to 18 show that the Cu, Zr, W, REM, Co and B contents in the preferred ranges provide good corrosion resistance at welds.

In No. 19, the Si content was outside the preferred range. No. 20 failed to satisfy the preferred ranges of the Si content and the value S. In No. 21, the Al content and the value S did not satisfy the preferred ranges. Nos. 22 to 24 did not satisfy the preferred ranges in any of the V content, the Nb content and the Ti content, as well as in the value N. In No. 25, the value N was outside the preferred range.

The ferritic stainless steels obtained in the present invention are suited for applications where structures are manufactured by welding, for example, such applications as automobile exhaust system components including mufflers, hot water storage can materials for electrical water heaters, and building materials such as fittings, ventilating openings and ducts.

The invention claimed is:

1. A ferritic stainless steel comprising, by mass %, C: 0.001 to 0.030%, Si: more than 0.3 to 0.55%, Mn: 0.05 to 0.50%, P: not more than 0.05%, S: not more than 0.01%, Cr: 19.0 to 28.0%, Ni: 0.01 to less than 0.30%, Mo: 0.2 to 3.0%, Al: more than 0.08 to 1.2%, V: 0.02 to 0.50%, Cu: less than 0.1%, Nb: 0.005 to 0.50%, Ti: 0.05 to 0.50%, and N: 0.001 to 0.030%, the balance being Fe and inevitable impurities, the ferritic stainless steel satisfying the following equations (1) and (2):

$$0.6 \leq Si+Al+Ti \leq 1.8 \quad (1)$$

$$Nb+1.3Ti+0.9V+0.2Al > 0.55 \quad (2)$$

wherein the chemical symbols in the expressions represent the contents (mass %) of the respective elements; and wherein the ferritic stainless steel sheet has a pitting potential of 0 mVolt or above.

2. The ferritic stainless steel according to claim 1, further comprising, by mass %, one or more selected from Zr: not more than 1.0%, W: not more than 1.0%, REM: not more than 0.1%, Co: not more than 0.3% and B: not more than 0.1%.

3. The ferritic stainless steel according to claim 2, wherein the ferritic stainless steel sheet has a reactivation rate of 0.01% or less.

4. The ferritic stainless steel according to claim 2 comprising, by mass %, Cr: 21.0 to 26.0%.

5. The ferritic stainless steel according to claim 4, wherein the ferritic stainless steel sheet has a reactivation rate of 0.01% or less.

6. The ferritic stainless steel according to claim 1 comprising, by mass %, Cr: 21.0 to 26.0%.

7. The ferritic stainless steel according to claim 6, wherein the ferritic stainless steel sheet has a reactivation rate of 0.01% or less.

8. The ferritic stainless steel according to claim 1, wherein the ferritic stainless steel sheet has a reactivation rate of 0.01% or less.

* * * * *